US006578242B2

(12) United States Patent
Yang

(10) Patent No.: US 6,578,242 B2
(45) Date of Patent: Jun. 17, 2003

(54) STRING CORE-FREE INVISIBLE ZIPPER STRUCTURE

(76) Inventor: Chin-Shui Yang, 5F, No. 3, Lane 32, Sec. 2 Feng-Nien Rd., Taipei (TW)

( * ) Notice: Subject to any disclaimer, the term of this patent is extended or adjusted under 35 U.S.C. 154(b) by 0 days.

(21) Appl. No.: 09/903,530

(22) Filed: Jul. 13, 2001

(65) Prior Publication Data

US 2003/0009860 A1 Jan. 16, 2003

(51) Int. Cl.[7] ..... A44B 19/40
(52) U.S. Cl. ..... 24/396; 24/391
(58) Field of Search ..... 24/381, 396, 391

(56) References Cited

U.S. PATENT DOCUMENTS 3,149,389 A * 9/1964 Steingruebner ..... 24/396
3,343,234 A * 9/1967 Chery ..... 24/396
3,609,827 A * 10/1971 Heimberger ..... 24/396
3,874,039 A * 4/1975 Takamatsu ..... 24/391
3,962,756 A * 6/1976 Ebata ..... 24/396

* cited by examiner

*Primary Examiner*—Robert J. Sandy
(74) *Attorney, Agent, or Firm*—Troxell Law Office PLLC

(57) ABSTRACT

String core-free invisible zipper structure including a pair of zipper belts and zipper teeth windingly extended and continuously lengthwise sewn along the inward folded edge of each zipper belt. Each zipper tooth has an upper and a lower leg sections and a head section. The gap between the upper and lower leg sections of the zipper tooth is gradually converged from the head section of the zipper tooth to the heels of the upper and lower leg sections, whereby the extensible tolerance of the connecting section between the upper and lower leg sections of adjacent zipper teeth is reduced and the deformation of the zipper teeth caused by lateral pull is reduced. Therefore, the zipper teeth have sufficient buckling strength and the possibility of disengagement of the zipper teeth is minimized. Therefore, the string core passing through the zipper teeth is no more necessary for reinforcing the anti-pull strength of the zipper teeth.

4 Claims, 3 Drawing Sheets

STRING CORE-FREE INVISIBLE ZIPPER STRUCTURE

BACKGROUND OF THE INVENTION

The present invention is related to a string core-free invisible zipper structure in which the extensible tolerance of the connecting section between the upper and lower leg sections of adjacent zipper teeth is reduced and the zipper teeth have better anti-pull strength and snapping ability. Therefore, without any string core passing through the zipper teeth, the zipper teeth still have sufficient strength. In addition, it is easier to sew the zipper and the manufacturing cost is reduced.

FIGS. 4 and 5 show an early zipper. After sewing, the seam of the zipper is exposed to an outer side of the zipper belt so that the appearance is poor. An invisible zipper has been developed to improve this. When sewn, the seam 12 is hidden in an inner face of the zipper belt to beautify the appearance. The invisible zipper includes a pair of zipper belts 1, with zipper teeth 2 continuously spiraled on one side of the inward folded edge of each zipper belt 1 and a slider slidably along the length of the inward folded edge for zipping the zipper on and off. The transverse gap 4 defined between the upper and lower leg sections 21, 22 of the zipper tooth 2 is equal to the inner diameter of the slider. Accordingly, after the zipper teeth are latched with each other, when subject to external force, the length of the connection sections 5 of the adjacent zipper teeth 2 still can absorb the increased tolerance caused by the shift of the transverse gap 4. Therefore, when the length of the connecting sections 5 of the zipper teeth 2 is increased, the snapping ability of the zipper teeth 2 is lowered or even totally lost. This leads to poor function of the zipper. An improved zipper has been developed. An auxiliary string core 6 is passed through the interior of the zipper teeth 2 and sewn or stitched on the zipper belt 1 by a yarn together with the upper and lower leg sections 21, 22 and the connecting sections 5. The string core 6 is retained between the upper and lower leg sections 21, 22 to reduce the gap therebetween. When the zipper teeth 2 are subject to external force, the string core 6 is compressed and flattened, the zipper belt 1 between the upper and lower leg sections 21, 22 is naturally shifted to the connecting sections 5. This leads to unstability of the zipper teeth. The string core further can press the connecting section 5 and prevent the same from being tensioned by external force and fix the zipper teeth 2 on the zipper belt 1 so as to keep a constant gap between the zipper teeth 2 and achieve a desired buckling effect. However, the string core 6 leads to higher cost and difficulty in manufacturing. Also, the thickness of the produce is increased. This affects the flatness of the appearance of the product. Furthermore, when repeatedly washed or subject to heat, the string core tends to deform or expand. Therefore, when pulling the slider, the slider will be obstructed or even damaged. This shortens the using life of the product.

In another type of invisible zipper, the lower leg sections of the zipper teeth are sewn by way of channel sewing. This is disadvantageous in that when the zipper teeth are pressed on front face, the zipper teeth will retract and disengage from each other during snapping.

SUMMARY OF THE INVENTION

It is therefore a primary object of the present invention to provide a string core-free invisible zipper structure including a pair of zipper belts and zipper teeth windingly extended and continuously lengthwise sewn along the inward folded edge of each zipper belt. The gap between the upper and lower leg sections of the zipper tooth is gradually converged from the head section of the zipper tooth to the heels of the upper and lower leg sections, whereby the extensible tolerance of the connecting section between the upper and lower leg sections of adjacent zipper teeth is reduced and the deformation of the zipper teeth caused by lateral pull is reduced. Therefore, the zipper teeth have sufficient buckling strength and the possibility of disengagement of the zipper teeth is minimized. Therefore, the string core passing through the zipper teeth is no more necessary for reinforcing the anti-pull strength of the zipper teeth. Without any string core passing through the zipper teeth, the zipper teeth still have sufficient strength. In addition, it is easier to sew the zipper and the manufacturing cost is reduced.

The present invention can be best understood through the following description and accompanying drawings wherein:

DETAILED DESCRIPTION OF THE PREFERRED EMBODIMENT

Figure 1:
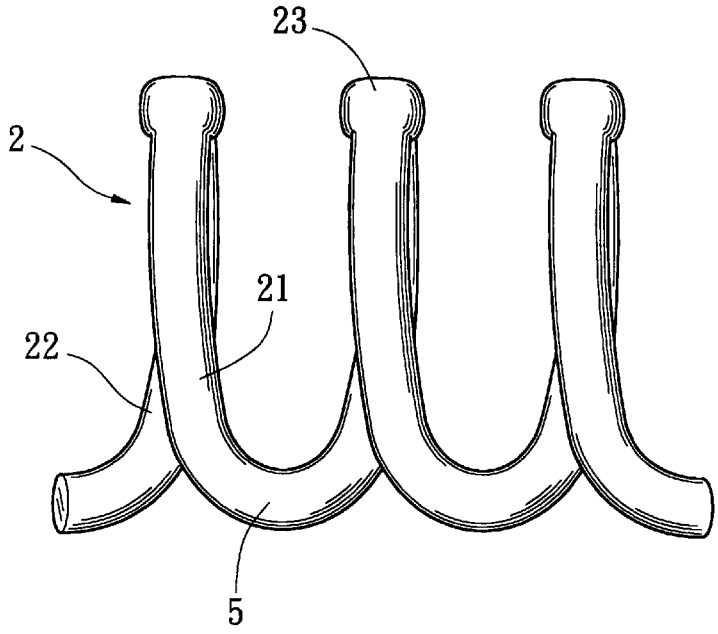
FIG. 1 is a top view of the zipper teeth of the present invention.
Figure 2:
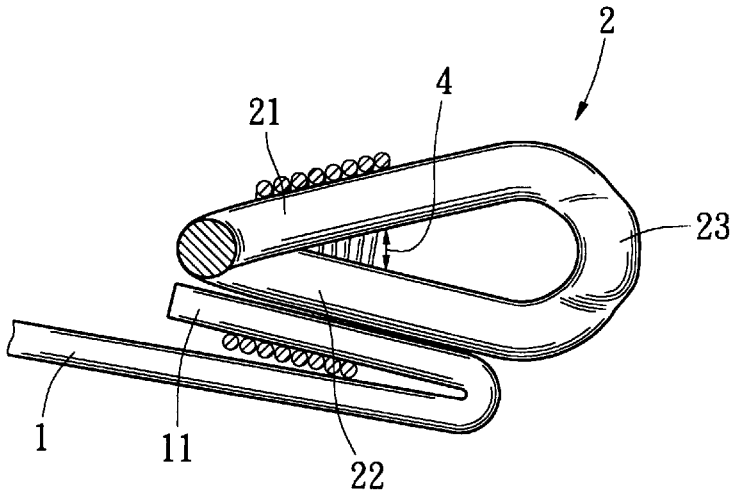
FIG. 2 is a cross-sectional view of the zipper teeth of the present invention.
Figure 3:
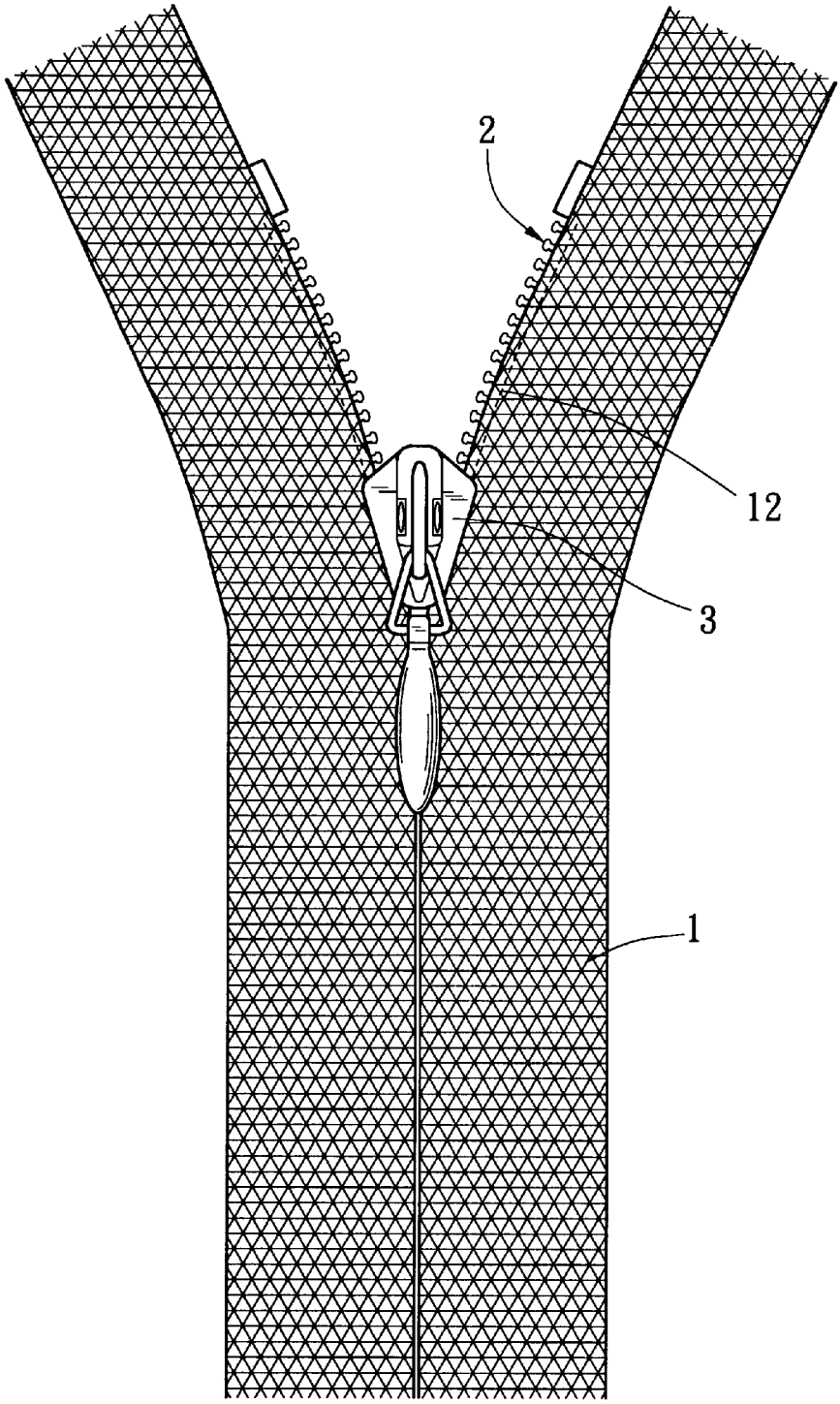
FIG. 3 shows the application of the zipper of the present invention.
Figure 4:
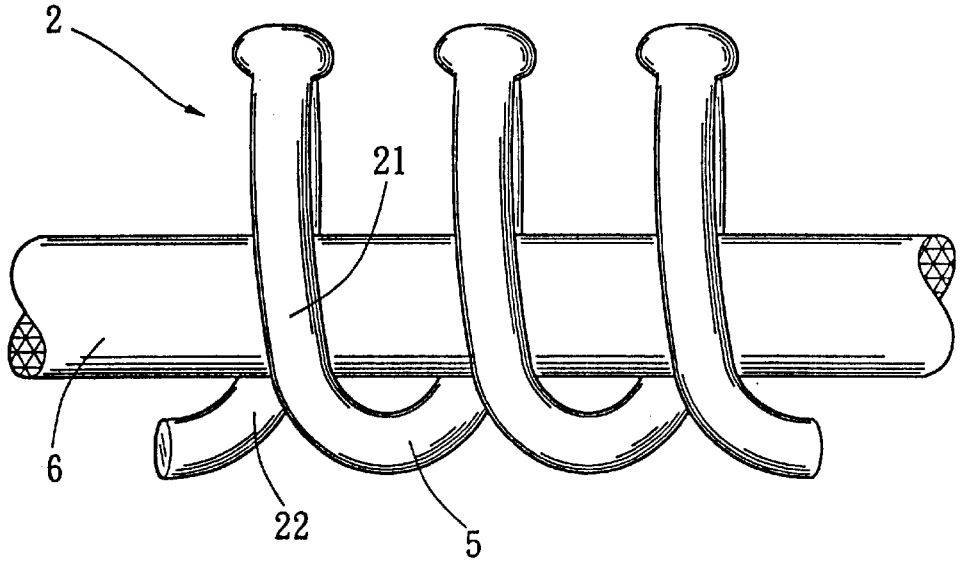
Fig. 4 (PRIOR ART)
FIG. 4 is a top view of the zipper teeth of a conventional invisible zipper.
Figure 5:
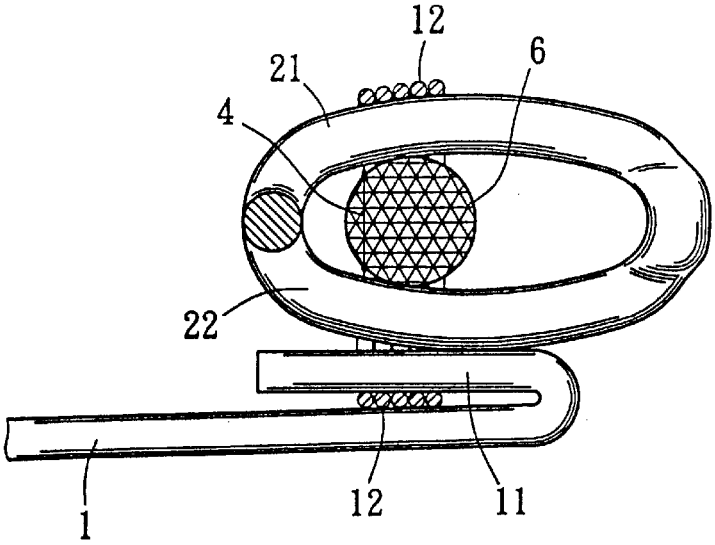
Fig. 5 (PRIOR ART)
FIG. 5 is a cross-sectional view of the zipper teeth of the conventional invisible zipper.

Please refer to FIGS. 1–3. The string core-free invisible zipper structure of the present invention includes a pair of zipper belts 1 and zipper teeth 2 windingly extended and continuously lengthwise sewn along the inward folded edge 11 of each zipper belt 1. The upper and lower leg sections of each zipper tooth 2 are connected by a connection section 5 with shorter winding length. The gap 4 between the upper and lower leg sections 21, 22 is gradually converged from the head 23 of the zipper tooth 2 to the heels of the upper and lower leg sections 21, 22 (in a form of substantially triangular or trapezoid frame). Therefore, there is no excessive pressable and shiftable part. Accordingly, when the zipper tooth 2 is subject to external pulling force, the connection section 5 is prevented from being elongated so that the snapping ability and anti-lateral pressure ability of the zipper teeth 2 can be maintained and the possibility of disengagement of the zipper teeth 2 is minimized. Therefore, the auxiliary string core between the upper and lower leg sections 21, 22 is no more necessary and sufficient strength for maintaining the gap of the zipper teeth 2 is achieved. In addition, it is easier to sew the zipper and the manufacturing cost is reduced. Also, the problem is eliminated that the thickness of the product is increased and when repeatedly washed or subject to heat, the string core tends to deform or expand. Therefore, when pulling the slider, the slider can be smoothly slided.

The above embodiment is only used to illustrate the present invention, not intended to limit the scope thereof. Many modifications of the above embodiment can be made without departing from the spirit of the present invention.

What is claimed is:

1. A string core-free invisible zipper structure comprising: a pair of zipper belts and zipper teeth continuously lengthwise sewn along an inward folded edge of each zipper belt, each zipper tooth having straight upper and lower leg sections extending from a head section, the straight upper and lower leg sections of the zipper tooth being symmetrical and gradually converging toward each other from the head section to heels of the upper and lower leg sections, whereby an extent to which a connection section between the upper and lower leg sections of adjacent zipper teeth can be extended is reduced, the zipper structure being devoid of string cores passing through the zipper teeth, one of the straight upper and lower legs being in direct contact with the inward folded edge of the associated zipper belts such that the zipper teeth are attached directly to the associated folded edge, such attachment being devoid of any reinforcing cord.

2. The string core-free invisible zipper structure as claimed in claim 1, wherein a winding path extending from the head section of the zipper tooth to the upper and lower leg sections is substantially triangular in cross-section.

3. The string core-free invisible zipper structure as claimed in claim 2, wherein the triangular cross-section is an equilateral triangle.

4. The string core-free invisible zipper structure as claimed in claim 1, wherein a winding path extending from the head section of the zipper tooth to the upper and lower leg sections is substantially trapezoidal in cross-section.

* * * * *